US011660513B2

(12) United States Patent
Wickum

(10) Patent No.: US 11,660,513 B2
(45) Date of Patent: May 30, 2023

(54) MECHANISMS AND METHODS FOR A RECREATIONAL GAME

(71) Applicant: Brian Wickum, Virginia Beach, VA (US)

(72) Inventor: Brian Wickum, Virginia Beach, VA (US)

( * ) Notice: Subject to any disclaimer, the term of this patent is extended or adjusted under 35 U.S.C. 154(b) by 0 days.

(21) Appl. No.: 17/243,433

(22) Filed: Apr. 28, 2021

(65) Prior Publication Data

US 2021/0331052 A1 Oct. 28, 2021

Related U.S. Application Data

(60) Provisional application No. 63/016,857, filed on Apr. 28, 2020.

(51) Int. Cl.

| | |
|---|---|
| ***A63B 67/06*** | (2006.01) |
| ***A63B 63/08*** | (2006.01) |
| ***A63B 71/06*** | (2006.01) |

(52) U.S. Cl.

CPC ..... *A63B 63/08* (2013.01); *A63B 67/06* (2013.01); *A63B 67/066* (2013.01); *A63B 71/0669* (2013.01); *A63B 2210/50* (2013.01)

(58) Field of Classification Search

CPC ..... A63B 63/08; A63B 67/06

USPC ..... 273/342

See application file for complete search history.

(56) References Cited

U.S. PATENT DOCUMENTS

| | | | | |
|---|---|---|---|---|
| 505,314 | A * | 9/1893 | Howell | A63F 7/0017 273/119 R |
| 689,054 | A * | 12/1901 | Bauer | A63B 63/08 273/342 |
| 719,456 | A * | 2/1903 | Gailey | A63B 63/08 273/342 |
| 5,207,432 | A * | 5/1993 | Miller | A63B 69/0053 273/342 |
| 5,622,369 | A * | 4/1997 | Rogers | A63B 67/066 273/342 |
| 6,843,478 | B1 * | 1/2005 | Hoepelman | A63B 63/06 273/342 |
| 7,207,565 | B1 * | 4/2007 | Masty, III | A63B 67/06 273/342 |
| 8,002,282 | B1 * | 8/2011 | Koski | A63B 63/083 273/342 |
| 9,782,666 | B2 * | 10/2017 | Dahl | A63B 69/40 |
| 10,828,555 | B2 * | 11/2020 | Howell | A63B 69/3661 |
| 2009/0194941 | A1 * | 8/2009 | Boyd | A63B 67/007 273/340 |

(Continued)

FOREIGN PATENT DOCUMENTS

| | | |
|---|---|---|
| WO | 2016168175 | 10/2016 |
| WO | WO-2020008417 A1 * | 1/2020 |

*Primary Examiner* — Laura Davison

(74) *Attorney, Agent, or Firm* — Troutman Pepper Hamilton Sanders LLP; Ryan A. Schneider; Korbin M. Blunck

(57) ABSTRACT

A recreational game including a throwable object, a plurality of reception mechanisms, and a deflection mechanism. The throwable object can be thrown by a player of the recreational game and received by a reception mechanism. The throwable object can be deflected by the deflection mechanism to change a direction of the throwable object when the throwable object contacts the deflection mechanism. The deflection mechanism can include a nonplanar surface.

13 Claims, 10 Drawing Sheets

(56) References Cited

U.S. PATENT DOCUMENTS

| | | | | |
|---|---|---|---|---|
| 2012/0013073 | A1* | 1/2012 | Wyland | A63B 67/066 273/287 |
| 2014/0015197 | A1 | 1/2014 | Maffei et al. | |
| 2018/0280776 | A1* | 10/2018 | Spady | A63B 71/0605 |

* cited by examiner

MECHANISMS AND METHODS FOR A RECREATIONAL GAME

CROSS-REFERENCE TO RELATED APPLICATIONS

This application claims benefit under 35 USC § 119(e) of U.S. Provisional Patent Application No. 63/016,857 filed 28 Apr. 2020, the entirety of which is incorporated herein by reference as if set forth herein in their entirety.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

SEQUENCE LISTING

Not Applicable

STATEMENT REGARDING PRIOR DISCLOSURES BY THE INVENTOR OR A JOINT INVENTOR

Not Applicable

BACKGROUND OF THE DISCLOSURE

1. Field of the Invention

The present disclosure relates generally to recreational games, and, more particularly, to recreational games involving a throwable object, a deflection mechanism, and a reception mechanism, and methods of playing the same.

2. Description of Related Art

Recreational games are often enjoyed by individuals for entertainment and to foster interactions between individuals. Games such as darts, pool, ping pong, corn hole, and the like are often played in social settings such as bars, college socials, family gatherings and other places of public or semi-private accommodation.

One type of game that has become popular in recent years is a game commonly referred to as "beer pong." Beer pong, often played as a drinking game but also enjoyable as a recreational game without alcohol, typically involves two or more individuals on opposite teams. Cups are arranged in patterns or arrays on each end of a table, and ping pong balls are thrown from the one end of the table towards the array on the opposite end of the table in an attempt to bounce the ball into one of the cups. As the balls are bounced into the cups, cups are removed and re-grouped to improve the likelihood that a ball will bounce into one of the cups.

Because Beer Pong is often played on a table with ping pong balls, beer pong is best suited for playing indoors on a ping pong, dining, or other similar table. As will be appreciated, there are occasions when individuals desire to play beer pong or other similar games in outdoor or non-traditional settings such as at a pool, a tailgate party, the beach, the lake, camping, or other outdoor or non-traditional settings. These settings, however, are not well suited for traditional beer pong arrangements. Typically these settings require the individual to transport a table to the location which is inconvenient, bounce the ball on the ground which can lead to contamination of the beverage in the cups, or attempt to play the game in windy conditions which can be difficult and frustrating for the players. Furthermore, simply bouncing the ping pong ball off a flat surface limits the difficulty of the game and provides for little variation in the arrangement and number of teams involved.

What is needed, therefore, is a mechanism and system for playing beer pong or similar games in outdoor or non-traditional settings while providing a variation on to the traditional beer pong arrangement and method of playing. These and other problems can be addressed by the technology disclosed herein.

SUMMARY

The disclosed technology relates generally to recreational games, and, more particularly, to recreational games involving a throwable object, a deflection mechanism, and a reception mechanism, and methods of playing the same.

The disclosed technology can include a recreational game having a throwable object configured to be thrown by a player of the recreational game. The recreational game can include a plurality of reception mechanisms with each reception mechanism of the plurality of reception mechanisms can be configured to receive the throwable object. The recreational game can include a deflection mechanism that can be configured to deflect the throwable object to change a direction of the throwable object when the throwable object contacts the deflection mechanism. The deflection mechanism can have a nonplanar surface such as a convex portion or a concave portion. The nonplanar surface, for example, can be a dome. The recreational game can include a plurality of deflection mechanisms and the plurality of deflection mechanisms can be configured to attach to one another.

The throwable object can be a ping pong ball, a rubber ball, or any other suitable throwable object. The reception mechanism can be a cup and can include a stake that can be configured to secure the cup in place when the stake is inserted into the ground.

The recreational game can include a plurality of support mechanisms. Each support mechanism can be configured to support a reception mechanism of the plurality of reception mechanisms. The plurality of support mechanisms can be configured to attach to the deflection mechanism to form a unitary assembly. Each reception mechanism of the plurality of reception mechanisms can be removably attachable to a support mechanism of the plurality of support mechanisms. At least a portion of the unitary assembly can be inflatable. The plurality of support mechanisms can be configured to attach to the deflection mechanism such that the deflection mechanism is positioned between the plurality of support mechanisms. As an example, the plurality of support mechanisms can be eight support mechanisms and each support mechanism of the plurality of support mechanisms can be configured to support six reception mechanisms of the plurality of reception mechanisms.

The recreational game can include a sensor that can be configured to detect when the throwable object has been received by a reception mechanism of the plurality of reception mechanisms. The recreational game can include a controller that can be configured to receive a signal from the sensor indicative of the reception mechanism of the plurality of reception mechanisms having received the throwable object. The controller can be configured to determine a score of the game based on the signal received from the sensor. The recreational game can include an electronic display configured to receive instructions from the controller to display the score of the game.

The disclosed technology can include a recreational game that can include a throwable object that can be configured to be thrown by a player of the recreational game and a dome configured to deflect the throwable object to change a direction of the throwable object when the throwable object contacts the dome. The recreational game can include a plurality of reception mechanisms with each reception mechanism of the plurality of reception mechanisms being configured to receive the throwable object. The recreational game can include a plurality of support mechanisms with each support mechanism of the plurality of support mechanisms being configured to (i) support a reception mechanism of the plurality of reception mechanisms and (ii) attach to the dome to form a unitary assembly.

The plurality of support mechanisms can be configured to attach to the dome such that the dome is positioned between the plurality of support mechanisms. As an example, the plurality of support mechanisms can comprise eight support mechanisms and each support mechanism of the plurality of support mechanism can be configured to support six reception mechanisms of the plurality of reception mechanisms.

These and other aspects, features, and benefits of the claimed invention(s) will become apparent from the following detailed written description of the preferred embodiments and aspects taken in conjunction with the following drawings, although variations and modifications thereto may be effected without departing from the spirit and scope of the novel concepts of the disclosure.

BRIEF DESCRIPTION OF THE DRAWINGS

Implementations, features, and aspects of the disclosed technology are described in detail herein and are considered a part of the claimed disclosed technology. Other implementations, features, and aspects can be understood with reference to the following detailed description, accompanying drawings, and claims. Wherever possible, the same reference numbers are used throughout the drawings to refer to the same or like elements of an embodiment. Reference will now be made to the accompanying figures and flow diagrams, which are not necessarily drawn to scale.

DETAILED DESCRIPTION

Figure 1A:
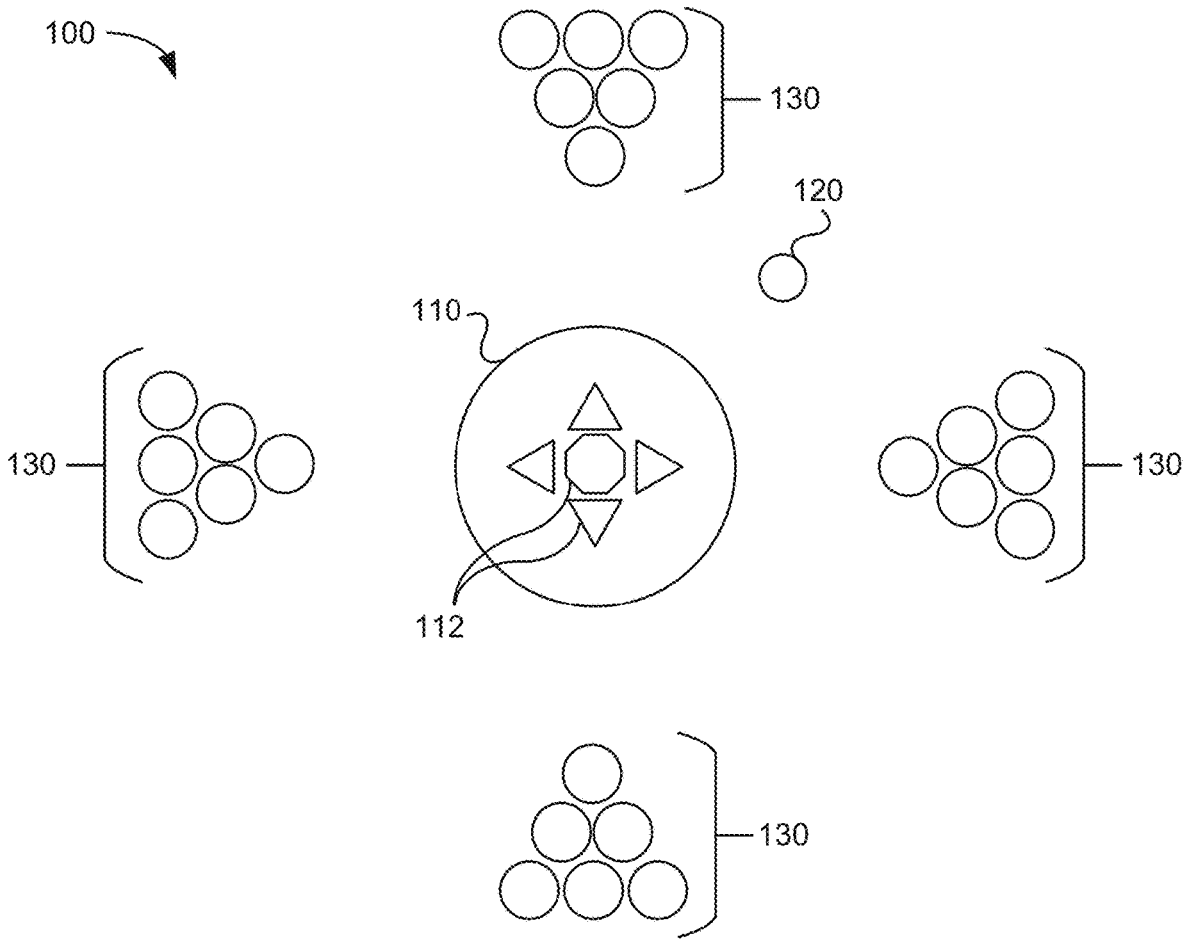
FIG. 1A is top view illustration of an example recreational game, in accordance with the disclosed technology.

The disclosed technology includes a recreational game that can include a throwable object, one or more reception mechanisms, and a deflection mechanism. Individuals playing the game can throw or toss the throwable object toward the deflection mechanism to bounce, slide, or otherwise deflect the throwable object off the deflection mechanism and toward a reception mechanism. For example, the deflection mechanism can be a dome or otherwise curved object that deflects the throwable object in various directions depending on the projection angle at which the throwable object is thrown. Generally, players gain points or win the game in the game by landing the throwable object in a reception mechanism by deflecting the throwable object off the deflection mechanism. As will become apparent throughout this disclosure, the disclosed technology can include several variations of the recreational game to vary the complexity and enjoyment of the game. Furthermore, the disclosed technology can be enjoyed by a single player or by multiple players depending on the configuration.

To facilitate an understanding of the principles and features of the various embodiments of the disclosure, various illustrative embodiments are explained below. Although certain examples of the disclosed technology are explained in detail, it is to be understood that other examples, embodiments, and implementations of the disclosed technology are contemplated. Accordingly, it is not intended that the disclosed technology is limited in its scope to the details of construction and arrangement of components set forth in the following description or illustrated in the drawings. As will become apparent throughout the disclosure, the disclosed technology can be implemented in a variety of examples and can be practiced or carried out in various ways.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named. In other words, the terms "a," "an," and "the" do not denote a limitation of quantity, but rather denote the presence of "at least one" of the referenced item.

As used herein, the term "and/or" may mean "and," it may mean "or," it may mean "exclusive-or," it may mean "one," it may mean "some, but not all," it may mean "neither," and/or it may mean "both." The term "or" is intended to mean an inclusive "or."

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose. It is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value. Further, the term "about" means within an acceptable error range for the particular value as determined by one of ordinary skill in the art, which will depend in part on how the value is measured or determined, i.e., the limitations of the measurement system. For example, "about" can mean within an acceptable standard deviation, per the practice in the art. Alternatively, "about" can mean a range of up to ±20%, preferably up to ±10%, more preferably up to ±5%, and more preferably still up to ±1% of a given value. Alternatively, the term can mean within an order of magnitude, preferably within 2-fold, of a value. Where particular values are described in the application and claims, unless otherwise stated, the term "about" is implicit and in this context means within an acceptable error range for the particular value.

Throughout this disclosure, various aspects of the disclosure can be presented in a range format. It should be understood that the description in range format is merely for convenience and brevity and should not be construed as an inflexible limitation on the scope of the disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

Throughout this description, various components may be identified having specific values or parameters, however, these items are provided as exemplary embodiments. Indeed, the exemplary embodiments do not limit the various aspects and concepts of the present disclosure as many comparable parameters, sizes, ranges, and/or values may be implemented. The terms "first," "second," and the like, "primary," "secondary," and the like, do not denote an order, quantity, or importance, but rather are used to distinguish one element from another.

It is noted that terms like "specifically," "preferably," "typically," "generally," and "often" are not utilized herein to limit the scope of the claimed disclosure or to imply that certain features are critical, essential, or even important to the structure or function of the claimed disclosure. Rather, these terms are merely intended to highlight alternative or additional features that may or may not be utilized in a particular embodiment of the present disclosure. It is also noted that terms like "substantially" and "about" are utilized herein to represent the inherent degree of uncertainty that may be attributed to any quantitative comparison, value, measurement, or other representation.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "50 mm" is intended to mean "about 50 mm."

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described hereinafter as making up the various elements of the present disclosure are intended to be illustrative and not restrictive. Many suitable materials that would perform the same or a similar function as the materials described herein are intended to be embraced within the scope of the disclosure. Such other materials not described herein can include, but are not limited to, materials that are developed after the time of the development of the disclosure, for example. Any dimensions listed in the various drawings are for illustrative purposes only and are not intended to be limiting. Other dimensions and proportions are contemplated and intended to be included within the scope of the disclosure.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, similar components that are developed after development of the presently disclosed subject matter.

Figure 1B:
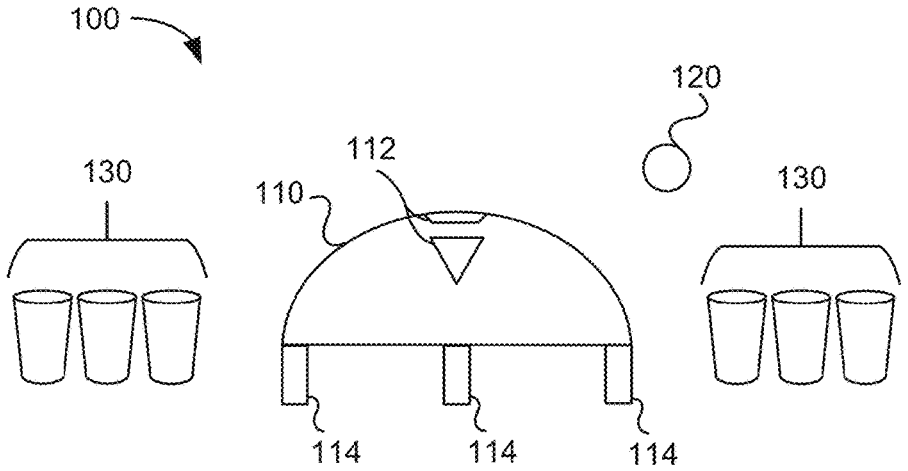
FIG. 1B is side view illustration of an example recreational game, in accordance with the disclosed technology.

Referring now to the drawings, in which like numerals represent like elements, the present disclosure is herein described. FIG. 1A is top view illustration while FIG. 1B is a side view illustration of an example recreational game 100, in accordance with the disclosed technology. The recreational game 100 can include a deflection mechanism 110, a throwable object 120, and one or more reception mechanisms 130. Although the game 100 can be played in many ways, the game 100 generally involves a player throwing or tossing the throwable object 120 toward the deflection mechanism 110 to bounce or deflect the throwable object 120 off the deflection mechanism 110 toward a reception mechanism 130. The game 100, for example, can be played by a player receiving points for the number of reception mechanisms 130 in which the player lands the throwable object 120. Alternatively, or in addition, the game 100 can be played by a player having an assigned set of reception mechanisms 130 and being required to remove one of his or her reception mechanisms 130 each time another player lands a throwable object 120 into one of his or her reception mechanisms 130. As will be appreciated, and as will be describe further herein, the game 100 can include many configurations and variations such that the game 100 can be played in various ways and in various settings. Each of the deflection mechanism 110, the throwable object 120, and the reception mechanism 130 can be sized for a particular application. For example, the deflection mechanism 110, the throwable object 120, and the reception mechanism 130 can each be a larger size for outdoor applications (e.g., the reception mechanism 130 can be a five gallon bucket and the throwable object 120 can be a sport ball such as a soccer ball or kick ball) or a smaller size for indoor applications (e.g., the reception mechanism 130 can be a cup and the throwable object 120 can be a ping pong ball). Furthermore, the recreational game 100 can be made portable for toting or storage such as in a bag, box, bucket, or other container.

As depicted in FIG. 1A, the reception mechanisms 130 can be positioned near the deflection mechanism 110 such that a player is able to bounce the throwable object 120 off the deflection mechanism 110 and into a reception mechanism 130. The game 100 can include a single reception mechanism 130 or multiple sets of reception mechanism 130 placed near the deflection mechanism 110. The reception mechanism 130 can be placed around the deflection mechanism 110 in various configurations. For example, the reception mechanisms 130 can be placed on a single side of the deflection mechanism 110, randomly near the deflection mechanism 110, in a circle around the deflection mechanism 110, or in various groupings around the deflection mechanism 110. In the example depicted in FIG. 1A, the game 100 can include four sets of reception mechanisms 130 spaced equally around the deflection mechanism 110 with each set having six reception mechanisms 130 placed in a triangular pattern. As will become apparent throughout this disclosure, the game 100 can be configured in various arrangements with the deflection mechanism 110 generally being placed near a reception mechanism 130 to facilitate the throwable object 120 being bounced off the deflection mechanism 110 and into a reception mechanism 130.

The deflection mechanism 110 can include a convex or otherwise dome shape and be configured such that the throwable object 120 can bounce or otherwise be deflected off the deflection mechanism 110. By having a deflection mechanism 110 that is a dome shape, a player is required to accurately project the throwable object 120 onto the deflection mechanism 110 such that the throwable object 120 will bounce into a desired reception mechanism 130. As will be appreciated by one of skill in the art, bouncing a throwable object 120 off a dome-shaped deflection mechanism 110 can be considerably more challenging than simply bouncing a throwable object 120 off a planar surface.

The deflection mechanism 110 can have one or more markings 112 to help the players determine where to throw the throwable object 120 to deflect the throwable object 120 toward the reception mechanism 130. The markings 112 can be any shape, size, color, or configuration. As a non-limiting example, and as depicted in FIGS. 1A and 1B, the markings can be or include polygons positioned to help a player align the projection of the throwable object 120 such that the throwable object 120 can be directed toward a reception mechanism 130. Alternatively, or in addition, the markings can include circles, stripes, colors, images, or various other markings to help the player align the projection of the throwable object 120.

The deflection mechanism 110 can be configured to be placed on a planar surface such as the ground or a table. The deflection mechanism 110 can include one or more legs 114 to help support the deflection mechanism 110 and ensure the deflection mechanism 110 is positioned at a desirable height. The deflection mechanism 110 can be made from any suitable material for the application. For example, and not limitation, the deflection mechanism 110 can be made from plastic, wood, metal, rubber, and/or composite materials. Furthermore, the deflection mechanism 110 can be a solid piece of material or a hollow piece of material and can comprise a single piece of material or multiple pieces of material assembled together.

The reception mechanism 130 can be any mechanism that can be configured to receive the throwable object 120. As a non-limiting example, the reception mechanism 130 can be a simple cup such as a plastic cup or a glass. As will be appreciated however, the reception mechanism 130 can comprise many other mechanisms that can be configured to receive the throwable object, for example, a can, a bowl, a cylinder, a box, a bucket, or any other suitable reception mechanism 130 for the particular arrangement. Furthermore, one reception mechanism 130 can be a different shape or configuration than another reception mechanism 130. For example, one reception mechanism 130 can have a circular opening while another reception mechanism can have a triangular opening. Points can be assigned to each reception mechanism 130 based on the shape and/or distance of the reception mechanism 130 from the deflection mechanism 110.

Figure 2:
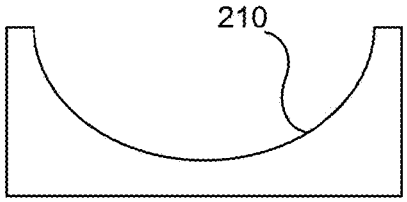
FIGS. 2-5 are side view illustrations of various example deflection mechanisms, in accordance with the disclosed technology.

FIG. 2 is a side view illustration of another example deflection mechanism 210. The deflection mechanism 210 can be a concave shape. The concave shape of the deflection mechanism 210 can be either circular or can be semi-tubular depending on the particular configuration. With deflection mechanism 210 being a concave shape, a player can stand beside the deflection mechanism 210 and bounce the deflection mechanism 210 off the inner side of the deflection mechanism 210 to either bounce the throwable object away from the player or back toward the player to land the throwable object 120 in a reception mechanism 130.

Figure 3:
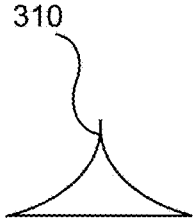

FIG. 3 is a side view illustration of another example deflection mechanism 310. The deflection mechanism 310 can comprise a cone having curved sides. Alternatively, or in addition, the deflection mechanism 310 can also have sloped sides similar to a traditional cone shape. A player can throw the throwable object 120 toward the deflection mechanism 310 to either bounce or slide the throwable object 120 off the deflection mechanism 310. If the player desires to bounce the throwable object 120 off the deflection mechanism 310, the player can position himself or herself on a side near the desired reception mechanism 130 such that the throwable object 120 bounces off the deflection mechanism 310 and generally back toward the player to land in a reception mechanism 130. Alternatively, or in addition, the player can throw the throwable object 120 toward the deflection mechanism 310 such that the throwable object 120 will slide off the deflection mechanism 310 and toward a reception mechanism 130.

Figure 4:
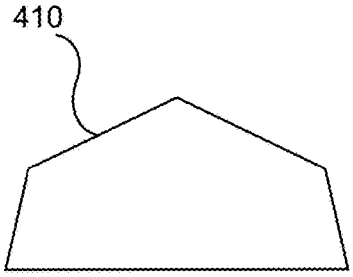

FIG. 4 is a side view illustration of another example deflection mechanism 410. The deflection mechanism 410 depicted in FIG. 4 comprises several planar surfaces such as, for example, a three-dimensional polygon. As will be appreciated, however, the deflection mechanism 410 can comprise any three-dimensional shape having one or more surfaces upon which a throwable object 120 can be deflected. By having one or more surfaces upon which the throwable object 120 can be deflected, a player can be required to determine the correct surface upon which the throwable object 120 should be deflected to direct the throwable object 120 toward a chosen reception mechanism 130.

Figure 5:
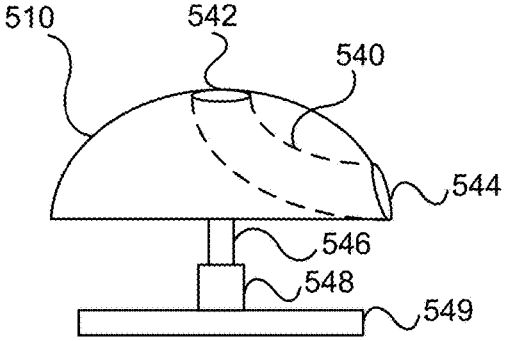

FIG. 5 is a side view illustration of another example deflection mechanism 510 having a semi-transparent top surface to illustrate an example chute 540 of the deflection mechanism 510. The deflection mechanism 510 can be configured such that a player can throw the throwable object 120 into an inlet 542 of the chute 540 and the throwable object 120 can exit the chute 540 through an outlet 544. Although depicted has having a single chute 540, the deflection mechanism 510 can have multiple chutes 540 arranged in various configurations.

The deflection mechanism 510 can be mounted on an axle 546 and supported by a base 549. A player can cause the deflection mechanism 510 to spin by applying a force to the deflection mechanism 510. By spinning the deflection mechanism 510, the outlet 544 can be at various positions at various points in time. A player can then determine when to throw the throwable object 120 into the inlet 542 such that the throwable object 120 exits the outlet 544 in time to land into one of the reception mechanisms 130.

The deflection mechanism 510 can also include an electric motor 548 that can be configured to spin the deflection mechanism 510. The electric motor 548 can be powered by a battery, a solar-powered system, grid power, or any other suitable power source. A player can turn on the electric motor 548 causing the deflection mechanism 510 to spin and then determine when the throw the throwable object 120 into the inlet 542 such that the throwable object 120 exits the outlet 544 and lands in a reception mechanism 130. As will be appreciated, depending on the configuration, a player can also bounce or slide the throwable object 120 off the deflection mechanism 510 to land the throwable object 120 in a reception mechanism 130.

Figure 6:
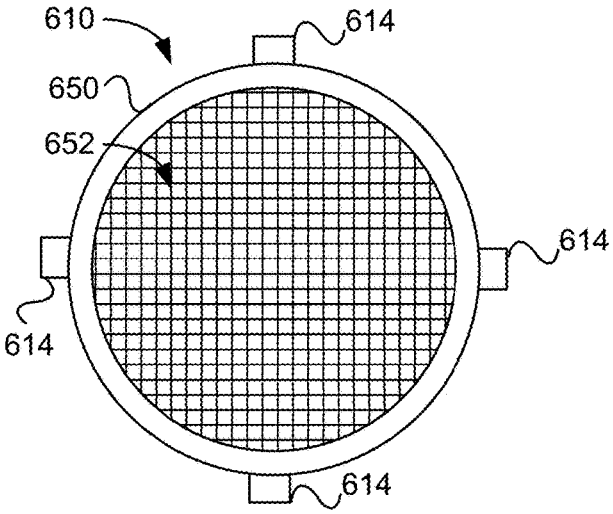
FIG. 6 is a top view illustration of an example deflection mechanism, in accordance with the disclosed technology.

FIG. 6 is a top view illustration of another example deflection mechanism 610 having an outer rim 650 and a net 652 supported by legs 614. The deflection mechanism 610 can be positioned near a reception mechanism 130 such that a player can bounce the throwable object 120 off the deflection mechanism 610 toward the reception mechanism 130. The deflection mechanism 610 can be a collapsible assembly or otherwise consist of several attachable components such that the deflection mechanism 610 can be made into a smaller configuration for toting or storage.

Figure 7:
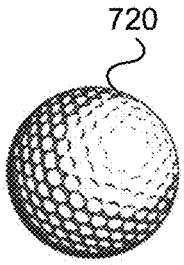
FIGS. 7-8 are illustrations of various example throwable objects, in accordance with the disclosed technology.
Figure 8:
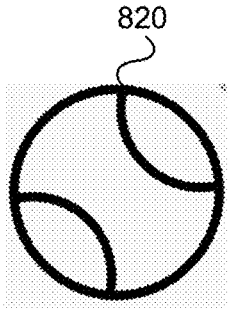

FIG. 7 illustrates a golf ball 720 while FIG. 8 illustrates a sports ball 820 that can each be used as a throwable object 120. FIGS. 7-8 are offered merely for illustrative purposes and should not be construed as limiting the scope of the throwable object 120. For example, the throwable object 120 can be a ping pong ball, a golf ball 720, a sports ball 820 (e.g., a tennis ball, a soccer ball, a basketball, a baseball, a racquet ball, a lacrosse ball, a beach ball, a kick ball, or any other similar ball), a rubber ball, a wooden ball, a metal ball, a rock, a bean bag, a dice, an object shaped like various polyhedrons, or any other suitable throwable object. Furthermore, as will be appreciated by one of skill in the art, the game 100 can include various versions of the throwable object 120 for adaptation in different environments. As a non-limiting example, the game 100 can include one throwable object 120 that is a ping pong ball for indoor use and a second throwable object 120 that is a rubber ball for outdoor use. Furthermore, if the game 100 is configured such that a player can slide the throwable object 120 off the deflection mechanism 310, the throwable object 120 can include an object such as the bean bag, wooden ball, rock, or other suitable object that is not as prone to bouncing off surfaces when compared to the ping pong ball, golf ball 720, or sports ball 820.

Figure 9:
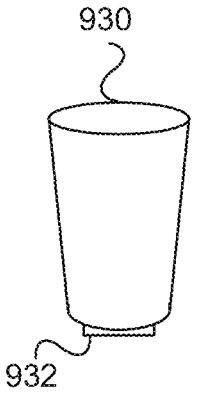
FIGS. 9-11 are illustrations of various example reception mechanisms, in accordance with the disclosed technology.
Figure 10:
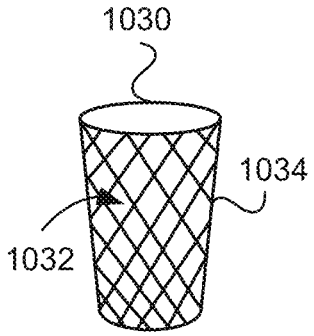
Figure 11:
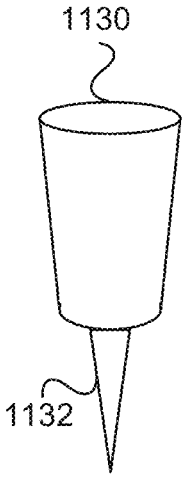

FIGS. 9-11 are illustrations of various example reception mechanisms 130, in accordance with the disclosed technology. Although FIGS. 9-11 illustrate examples of the reception mechanism 130, the examples are offered as illustrative examples and should not be construed as limiting. For example, the reception mechanism 130 can simply be a circle or other shape drawn in the sand or on the ground with a player attempting to land the throwable object 120 within the circle or other shape drawn on the ground. Furthermore, the reception mechanism 130 should not be limited in size and can be any size suitable for the particular application. As depicted in FIG. 9, the reception mechanism 930 can be similar to the reception mechanism 130 herein described but further include a securing mechanism 932 to help prevent the reception mechanism 930 from being moved. The securing mechanism 932 can be any mechanism that can help prevent the reception mechanism 930 from moving from its place as a result of receiving the throwable object 120. For example, and not limitation, the securing mechanism 932 can be a hook-and-loop fastener, a magnet, a weight, a non-slip pad, a sticky material, a fastener, or any other suitable mechanism to reduce the likelihood that the reception mechanism will be moved from its place.

FIG. 10 illustrates another example reception mechanism 1030 having a netting 1032. The netting 1032 can be configured to receive the throwable object 120 when the throwable object 120 enters the reception mechanism 1030. As will be appreciated, the reception mechanism 1030 can include a support frame 1034 to help support the netting 1032. The support frame 1034 can be a wire frame, a cup, a can, a cylinder, or any suitable mechanism that can support the netting 1032 such that the netting 1032 can receive the throwable object 120.

FIG. 11 illustrates yet another example reception mechanism 1130 having a protrusion 1132 to help secure the reception mechanism 1130 in place. The protrusion 1132, for example, can be a spike, a stake, a rod, a pin, or other protrusion such that the reception mechanism 1130 can be secured in the ground or in a corresponding piece of the game 100.

Figure 12:
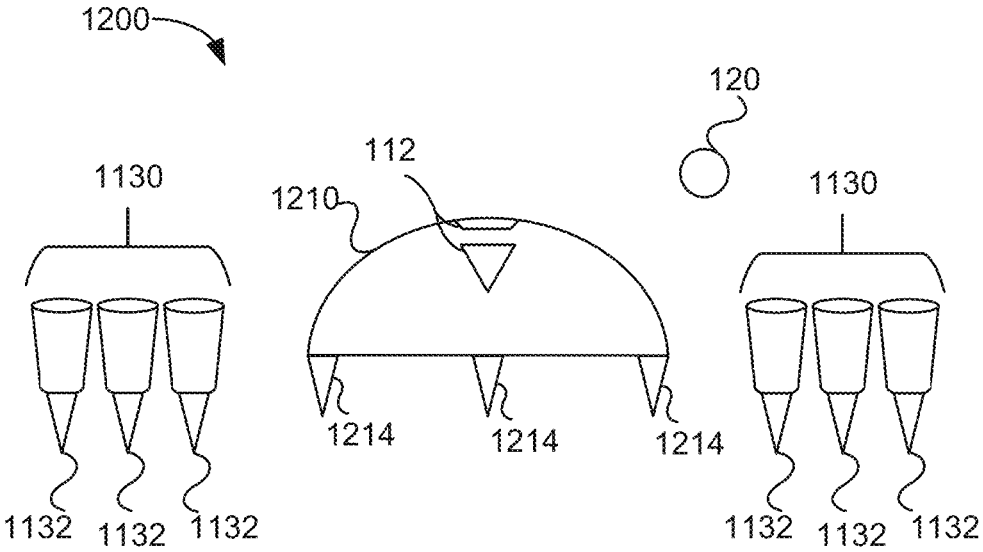
FIGS. 12-14 are side view illustrations of various examples of the recreational game, in accordance with the disclosed technology.

If the protrusion 1132 is a spike or stake, for example, the disclosed technology can include a game 1200 that is configured for outdoor play as depicted in FIG. 12. For example, the game 1200 can include reception mechanisms 1130 that each have a protrusion 1132 such that the reception mechanisms 1130 can be secured to the ground. This can be particularly helpful, for example, if the game 1200 is to be played outdoors at a beach, a lake, or other outdoor location where wind could blow over the reception mechanisms 1130 if not for the protrusion 1132. The protrusion 1132 can be sized and shaped to facilitate insertion of the protrusion 1132 into the ground and to prevent the reception mechanism 1130 from being moved out of place.

To help further facilitate outdoor play of the game 1200, the deflection mechanism 1210 can also include protrusions 1214 that are the same or similar to the protrusion 1132. To illustrate, if a player desires to play the game 1200 outdoors at the beach, the player can insert the protrusion 1132 of each reception mechanism 1130 and the protrusions 1214 of the deflection mechanism 1210 into the ground to ensure the players are able to enjoy the game 1200 in an outdoor location.

Figure 13:
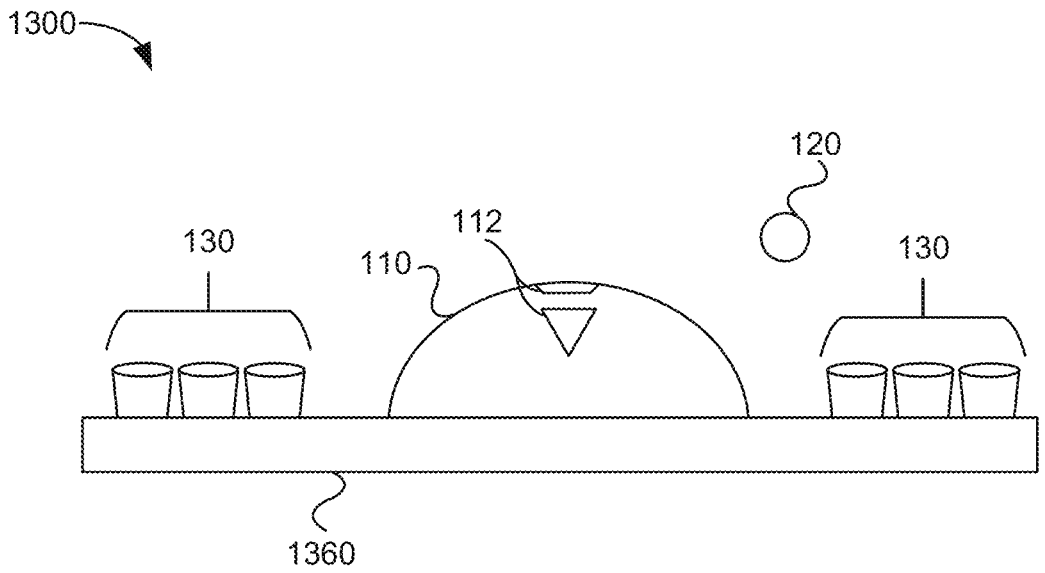

FIG. 13 illustrates another example game 1300 having a support board 1360. The support board 1360 can be configured to support the deflection mechanism 110 and the reception mechanisms 130 such that the game 100 forms a unitary assembly. The support board 1360, for example, can be a piece of material having one or more holes, apertures, or other connection points to receive and support the deflection mechanism 110 and the reception mechanism 130. As another example, the support board 1360 can be a portion of the game 100 and the game 100 can be a continuous piece of material such as a continuous piece of molded plastic to form the game 100. The connection points of the support board 1360 can be positioned such that the deflection mechanism 110 and the reception mechanisms 130 can be properly placed to set up the game 100.

Figure 14:
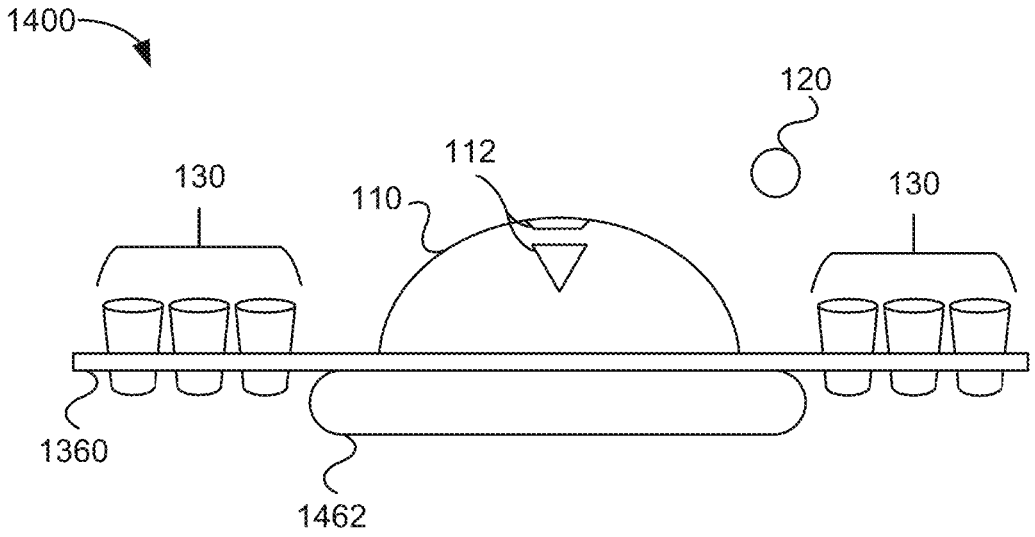

FIG. 14 illustrates another example game 1400 having a support board 1360 and a buoyant portion 1462. The buoyant portion 1462 can, for example, facilitate playing the game 100 in a pool, a lake, an ocean, or other places where it may be desirable to play the game 1400 in water. The buoyant portion 1462 can be sized and positioned to provide a stable platform upon which the game 1400 can be played when placed in water. The buoyant portion 1462, for example, can be an inflatable portion, a hollow portion, or be made from buoyant materials such as foam or wood. Furthermore, although depicted as a single piece, the buoyant portion 1462 can comprise several buoyant portions positioned to provide a stable platform upon which the game 1400 can be played when placed in water. As another example, the deflection mechanism 110 can also be inflatable to help provide further buoyancy and stabilization to the game 1400 when placed in water. Furthermore, the game 1400 can be configured such that each portion except for the throwable object 120 can be inflatable, either as a single continuous inflatable assembly or as separate inflatable portions. Although not shown, the game 1400 can include a counter weight, gyroscope, anchor, rudder, or other stabilizing device to help keep the game 1400 stable when played, for example, in a lake, a sea, an ocean, a river, or water that is otherwise turbulent.

Figure 15:
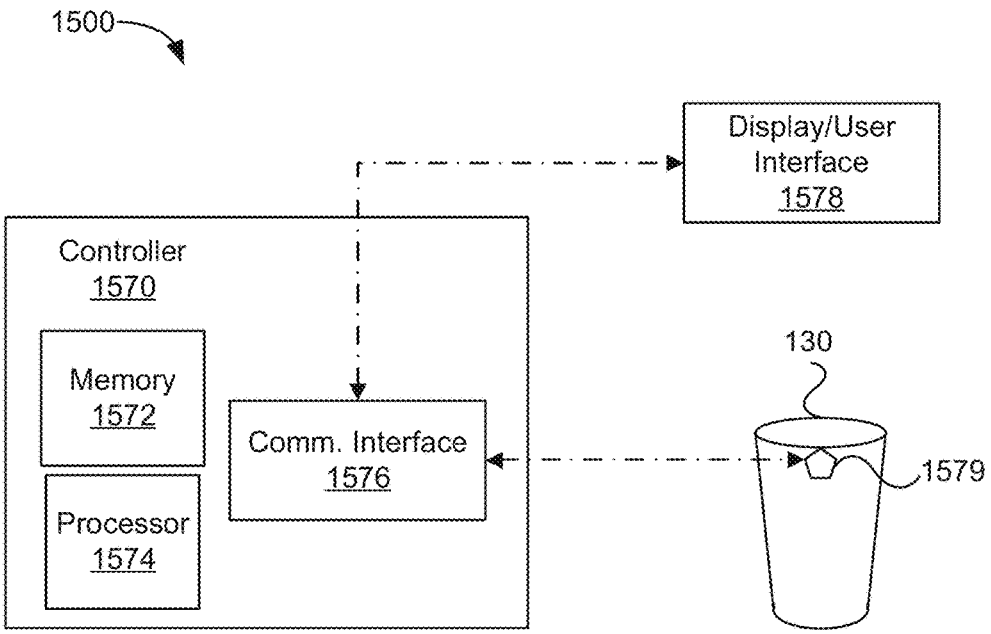
FIG. 15 is an illustration of a sensor, controller, and display/user interface of the recreational game, in accordance with the disclosed technology.

FIG. 15 is an illustration of a sensor 1579, a controller 1570, and display/user interface 1578 of a recreational game 1500. The controller 1570 can have a memory 1572, a processor 1574, and a communication interface 1576 to facilitate communication with the sensor 1579 and the display/user interface 1578. The sensor 1579 can be configured to output a signal to the controller 1570 whenever the throwable object 120 is received by one of the reception mechanisms 130. For example, the sensor 1579 can be a photoelectric sensor, a weight sensor, an inductive proximity sensor, an ultrasonic sensor, a capacitive proximity sensor, an accelerometer, a motion sensor, a limit switch, a magnetic sensor, or any other suitable sensor or sensor configuration that is capable of detecting when the throwable object 120 has been received by the reception mechanism 130 and outputting a signal to the controller 1570.

As a non-limiting example, the controller 1570 can be configured to receive a signal from the sensor 1579 and determine, based on the signal, a score of the game 1500. To help ensure the score is properly tracked, each reception mechanism 130 can be assigned a value and a particular team and the score can be determined by the controller 1570 based on which reception mechanism 130 the throwable object 120 has entered. The controller 1570 can be configured to determine when a particular player or team has won the game. Furthermore, the controller 1570 can be configured to determine a score of the game based on various rules stored in the memory 1572 of the controller 1570. For example, the controller 1570 can be configured to assign points based on the number of players, the number of reception mechanisms 130, and which version of the game the players desire to play. The controller 1570 can be configured to store data in the memory associated with many variations of the game 1500 such that the players can select which version of the game 1500 the players desire to play.

The controller 1570 can have a memory 1572, a processor 1574, and a communication interface 1576. The controller 1570 can be a computing device configured to receive data, determine actions based on the received data, and output a control signal to the display/user interface 1578. One of skill in the art will appreciate that the controller 1570 can be installed in any location, provided the controller 1570 is in communication with the sensor 1579 and the display/user interface 1578. Furthermore, the controller 1570 can be configured to send and receive wireless or wired signals and the signals can be analog or digital signals. The wireless signals can include Bluetooth™, BLE, WiFi™, ZigBee™, infrared, microwave radio, or any other type of wireless communication as may be suitable for the particular application. The hard-wired signal can include any directly wired connection between the controller and the other components described herein. Alternatively, the components can be powered directly from a power source and receive control instructions from the controller 1570 via a digital connection. The digital connection can include a connection such as an Ethernet or a serial connection and can utilize Modbus, fieldbus, PROFIBUS, SafetyBus p, Ethernet/IP, or any other suitable communication protocol for the application. Furthermore, the controller 1570 can utilize a combination of wireless, hard-wired, and analog or digital communication signals to communicate with and control the various components. One of skill in the art will appreciate that the above configurations are given merely as non-limiting examples and the actual configuration can vary depending on the particular application.

The controller 1570 can include a memory 1572 that can store a program and/or instructions associated with the functions and methods described herein and can include one or more processors 1574 configured to execute the program and/or instructions. The memory 1572 can include one or more suitable types of memory (e.g., volatile or non-volatile memory, random access memory (RAM), read only memory (ROM), programmable read-only memory (PROM), erasable programmable read-only memory (EPROM), electrically erasable programmable read-only memory (EEPROM), magnetic disks, optical disks, floppy disks, hard disks, removable cartridges, flash memory, a redundant array of independent disks (RAID), and the like) for storing files including the operating system, application programs (including, for example, a web browser application, a widget or gadget engine, and or other applications, as necessary), executable instructions and data. One, some, or all of the processing techniques or methods described herein can be implemented as a combination of executable instructions and data within the memory.

The controller 1570 can also have a communication interface 1576 for sending and receiving communication signals between the various components. Communication interface 1576 can include hardware, firmware, and/or software that allows the processor(s) 1574 to communicate with the other components via wired or wireless networks, whether local or wide area, private or public, as known in the art. Communication interface 1576 can also provide access to a cellular network, the Internet, a local area network, or another wide-area network as suitable for the particular application. By accessing a cellular network, the Internet, a local area network, or another wide-area network, the controller 1570 can be configured to receive periodic updates and/or to download additional game options that can be made available via an online store.

Additionally, the controller 1570 can have or be in communication with a display/user interface 1578 for displaying game information and receiving inputs from a player of the game. The display/user interface 1578 can be installed locally or be a remotely controlled device such as a mobile device. The player, for example, can view game data on the display/user interface 1578 and input data or commands to the controller 1570 via the display/user interface 1578. For example, the player can view game options that have been stored in the memory, other game options available for download, the current score, game history, or other similar data on the display/user interface. As a non-limiting example, the display/user interface 1578 can be a screen mounted on the game 1500 that has one or more buttons and/or a touch screen configured to receive input from the player. As another non-limiting example, the display/user interface 1578 can be a player's mobile device and an application can be downloaded to the mobile device that facilitates communication with the communication interface 1576, displays game information, and receives input data from the player.

As will be appreciated by one of skill in the art, the controller 1570, the display/user interface 1578, and the sensor 1579 can be applied to each of the examples described herein. Furthermore, the controller 1570, the display/user interface 1578, and the sensor 1579 can be powered by any suitable power source such as a battery, a solar powered system, and/or grid power.

Figure 16:
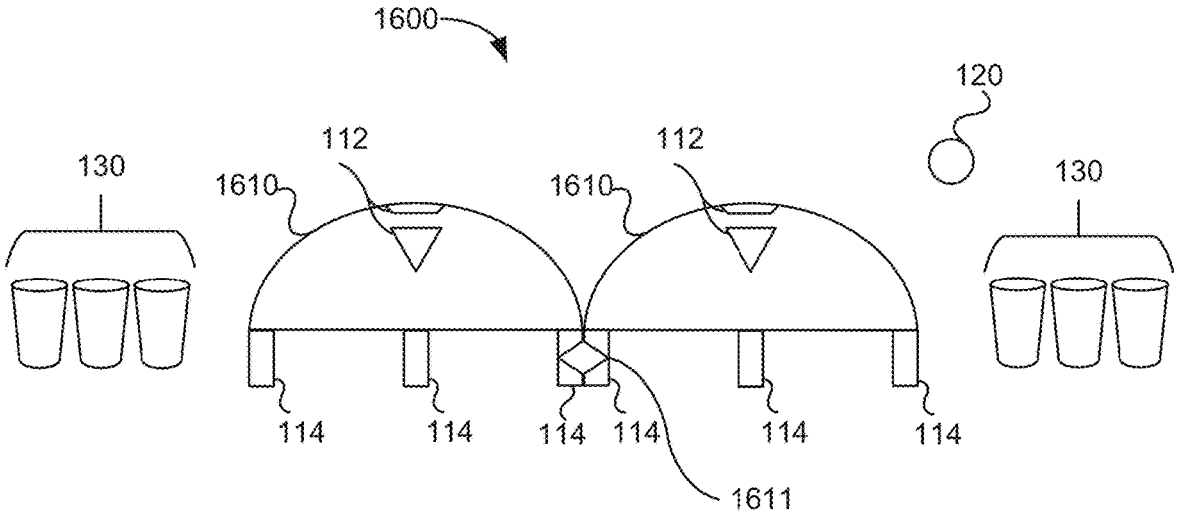
FIG. 16 is an illustration of an example recreational game having multiple deflection mechanisms, in accordance with the disclosed technology.

FIG. 16 is an illustration of an example recreational game 1600 having multiple deflection mechanisms 1610. The game 1600 for example, can have multiple deflection mechanisms 1610 that can be configured to attach to one another to form a larger game 1600. Each of the deflection mechanisms 1610 can be useable by itself but can also be attachable to another deflection mechanism 1610. This can be useful, for example, when large groups or multiple teams desire to play the game simultaneously. As a non-limiting example, if a single deflection mechanism 1610 can facilitate at least eight players or teams playing the game 1600, attaching multiple deflection mechanisms 1610 together can facilitate twelve or more players or teams to play the game 1600. Alternatively, or in addition, even if only a single player or a small number of players are present, attaching multiple deflection mechanisms 1610 together can potentially facilitate a more challenging and enjoyable arrangement of the game 1600.

The deflection mechanisms 1610 can include one or more attachment mechanisms 1611 configured to facilitate attaching the deflection mechanisms 1610 together. The attachment mechanisms 1611 can be, for example, hook-and-loop fasteners, one or more bolts and nuts, magnets, corresponding portions of the deflection mechanisms 1610 configured to be press-fitted together, a zipper, an elastic band, a rope, a snap-fit button, or any other attachment mechanism suitable for the application.

Figure 17:
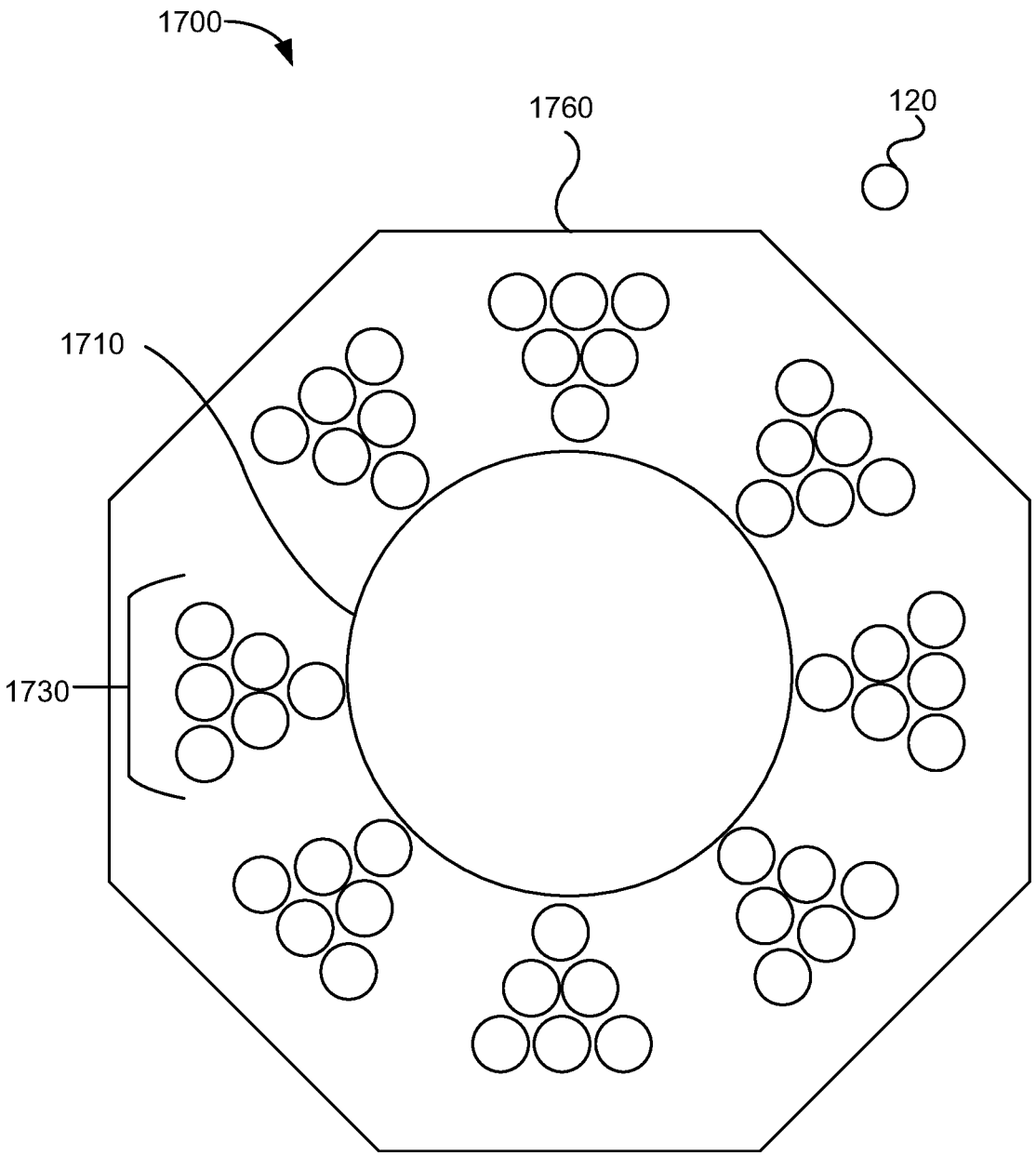
FIG. 17 is top view illustration of an assembly of the recreational game, in accordance with the disclosed technology.

FIGS. 17-19B depict a portable game 1700 having multiple parts that can be assembled together to form a game similar to game 100. A top view of the portable game 1700 is illustrated in FIG. 17. The portable game 1700 can include a throwable object 120, a deflection mechanism 1710, one or more support pieces 1760, and one or more reception mechanisms 130. As will be described herein, the deflection mechanism 1710, the one or more support pieces 1760, and the one or more reception mechanisms 130 can be attached together to form the assembled portable game 1700. When the portable game 1700 is assembled, the deflection mechanism 1710 can be positioned between multiple sets of reception mechanisms 1730 to facilitate multiple players or teams playing the portable game 1700. The portable game 1700, for example, can have eight sets of reception mechanisms 1730 with each set of reception mechanisms 1730 having six reception mechanisms 1730. The portable game 1700 can, however, be configured to have any number of reception mechanisms 1730 depending on the desired configuration of the portable game 1700. The portable game 1700 can be played by any number of players and/or teams including, one, two, three, four, five, six, seven, eight, or more players and/or teams.

Figure 18A:
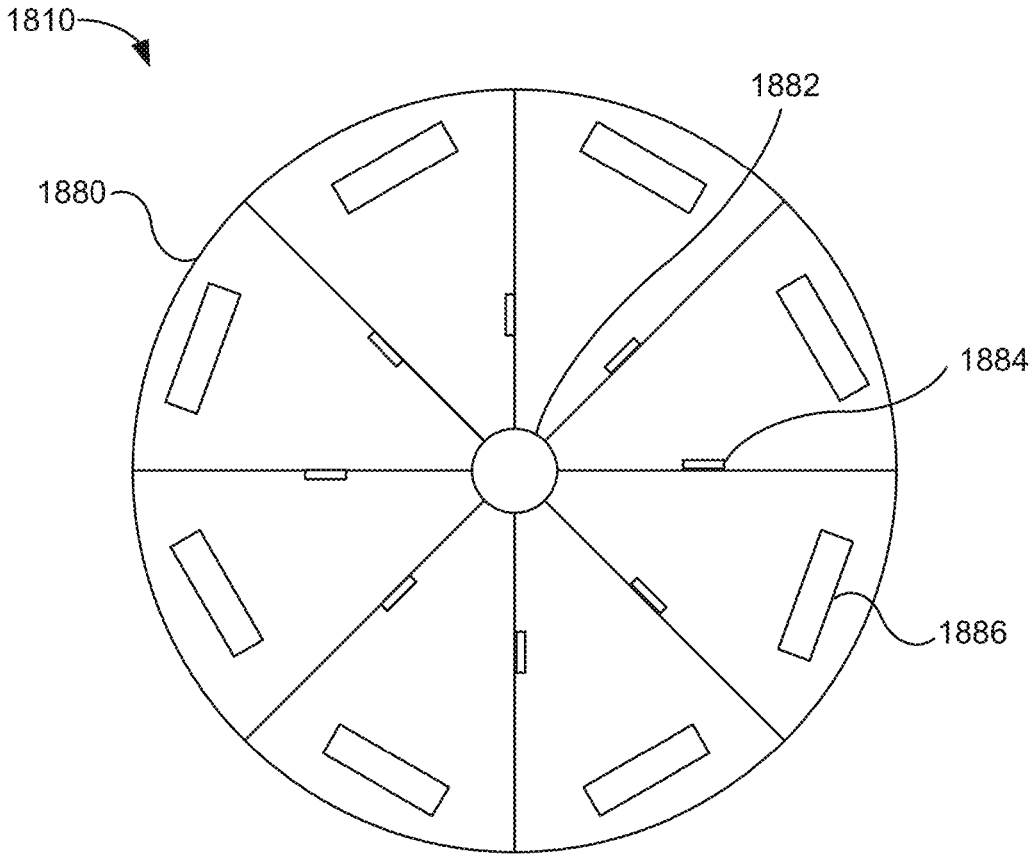
FIG. 18A is a top view illustration of a dome assembly of the recreational game illustrated in FIG. 17, in accordance with the disclosed technology.

FIG. 18A illustrates a top view of a deflection mechanism 1810 of the portable game 1700. Although depicted as having a dome shape, one of skill in the art will appreciate that the deflection mechanism 1810 can comprise any of the shapes or variations of deflection mechanisms described herein. The deflection mechanism 1810 can comprise multiple deflection pieces 1880 assembled together to form the deflection mechanism 1810. This can be useful, for example, for collapsing the portable game 1700 into smaller portions for toting and/or storing the portable game 1700. Each deflection piece 1880 can include an attachment mechanism 1884 and a support mechanism 1886. The attachment mechanisms 1884 can be configured to interlock or otherwise attach to a corresponding deflection piece 1880 to facilitate assembly of the deflection mechanism 1810. The attachment mechanism 1884 of one deflection piece 1880, for example, can be sized and configured to form a press fit when pushed together with another deflection piece 1880 to facilitate assembly of the deflection mechanism 1810. Alternatively, or in addition, the attachment mechanisms 1884 can include magnets, a hook-and-look fastener, a snap-fit, a press fit button, a bolt and a nut, an elastic band, a buckle, or any other suitable mechanism for attaching one deflection piece 1880 to a neighboring deflection piece 1880. Although only a single attachment mechanism 1884 is shown for each deflection piece 1880 in FIG. 18A, one of skill in the art will appreciate that each deflection piece 1880 can have more than one attachment mechanism 1884 to facilitate assembly of the deflection mechanism 1810.

Figure 18B:
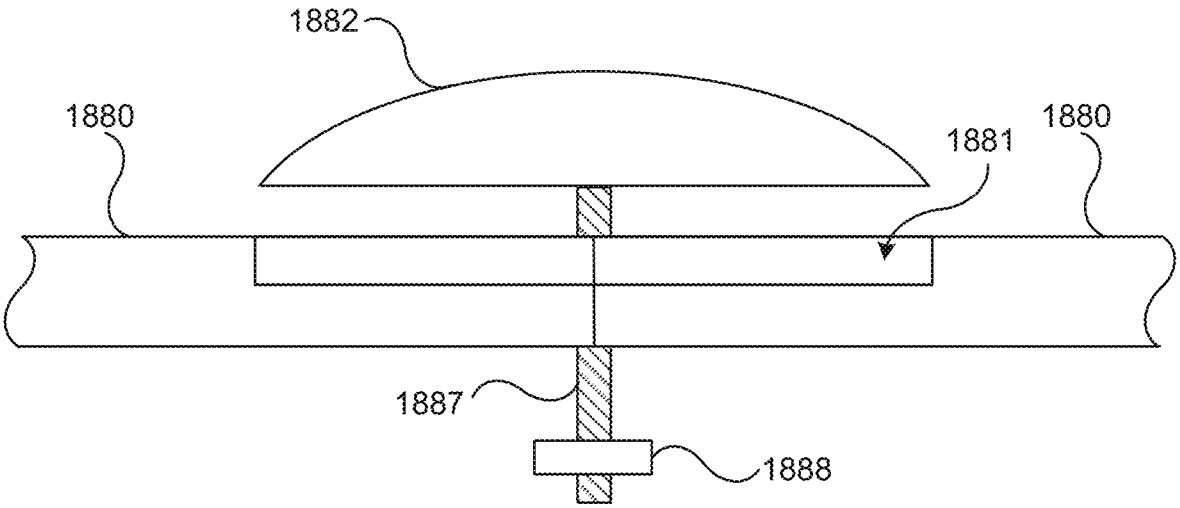
FIG. 18B is a side view illustration of a mechanism for securing the dome assembly of FIG. 18A, in accordance with the disclosed technology.

The deflection pieces 1880 can be further secured together by a cap 1882. FIG. 18B illustrates a detail view of the cap 1882 with a portion of the deflection pieces 1880 visible. The cap 1882 can be sized to fit into a recess 1881 of the deflection pieces 1880 such that a top surface of the cap 1882 can be configured to be flush with a top surface of the deflection pieces 1880. The cap 1882 can have a threaded portion 1887 and a nut 1888 to facilitate securing the cap 1882 in place and securing the deflection pieces 1880 together. The nut 1888 can be threaded onto the threaded portion 1887 and twisted firmly against the deflection pieces 1880 to ensure the deflection pieces 1880 do not break apart during game play.

Figure 19A:
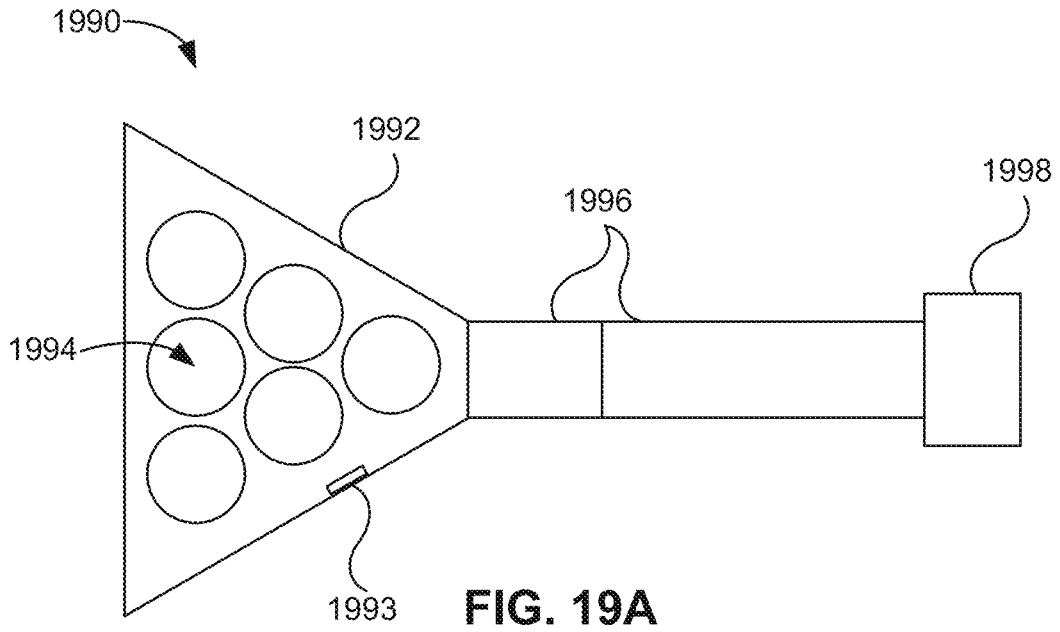
FIG. 19A is a top view illustration of an example support mechanism of the recreational game illustrated in FIG. 17, in accordance with the disclosed technology.
Figure 19B:
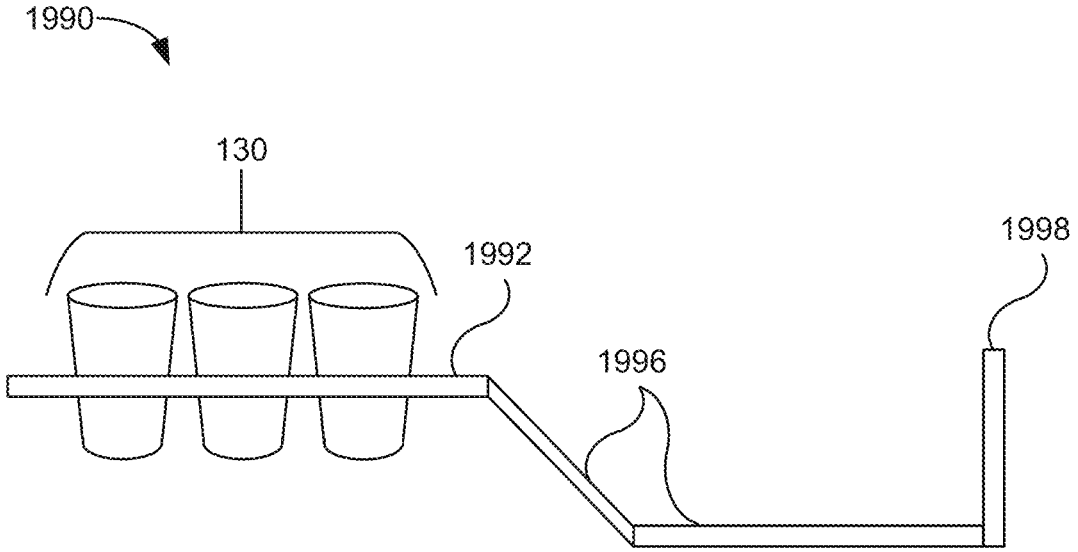
FIG. 19B is a side view illustration of an example support mechanism and reception mechanisms of the recreational game illustrated in FIG. 17, in accordance with the disclosed technology.

The support mechanisms 1886 of each deflection piece 1880 can receive a reception mechanism holder 1990 that can receive one or more reception mechanisms 130. As illustrated in FIGS. 19A-19B, the reception mechanism holder 1990 can include a support plate 1992 that can have one or more apertures 1994 that can be sized to receive a reception mechanism 130. FIG. 19A is a top view of the reception mechanism holder 1990 depicting the apertures 1994 while FIG. 19B is a side view of the reception mechanism holder 1990 depicting reception mechanisms 130 inserted into the apertures 1994. The support plate 1992 can be sized and shaped such that when the portable game 1700 is fully assembled, the support plates 1992 contact neighboring support plates 1992 and form the octagonal or otherwise polygonal shape of the portable game 1700 as shown in FIG. 17. As will be appreciated, the support plate 1992 can comprise other shapes and sizes depending on the particular application such that the portable game 1700 can form a different shape when assembled.

Each support plate 1992 can have an attachment mechanism 1993 configured to interlock or otherwise attach a support plate 1992 to a neighboring support plate 1992 when the portable game 1700 is assembled. The attachment mechanism 1993 can be the same as, or similar to, the attachment mechanism 1884 such as a press fit, magnets, a hook-and-look fastener, a snap-fit, a press fit button, a bolt and a nut, an elastic band, a buckle, or any other suitable mechanism for attaching one support plate 1992 to a neighboring support plate 1992.

The apertures 1994 can be sized to receive any size of reception mechanism 130 such as a reception mechanism 130 sized specifically for the portable game 1700, a reception mechanism 130 commonly used for other purposes such as a plastic drinking cup, or any of the variations of reception mechanisms described herein. Alternatively, or in addition, the portable game 1700 can be played without having any reception mechanisms 130 placed in the apertures 1994 and the throwable object 120 can simply fall through the apertures 1994. The apertures 1994 can have a sensor (e.g., sensor 1579) that can be in communication with a controller (e.g., controller 1570) to track the score of the game as previously described in relation to FIG. 15. The sensor 1579 can be further configured to determine the presence of a reception mechanism 130 and the controller 1570 can determine the number of players and/or teams and the chosen game configuration based on the number and location of reception mechanisms 130.

The reception mechanism holder 1990 can further include an extension arm 1996 and an attachment arm 1998. The extension arm 1996 can be sized to extend outwardly from the deflection mechanism 1810 to ensure the reception mechanisms 130 are properly positioned with respect to the deflection mechanism 1810. The extension arm 1996 can also be configured to support the reception mechanism 130 off the ground to help secure the reception mechanism 130 as depicted in FIG. 19B. The attachment arm 1998 can be configured to be inserted or otherwise attached to a support mechanism 1886 to attach the reception mechanism holder 1990 to the deflection mechanism 1810. The attachment arm 1998 can attach to the support mechanism 1886 by any of the same or similar attachment means described herein, including, but not limited to a press fit, magnets, a hook-and-look fastener, a snap-fit, a press fit button, a bolt and a nut, an elastic band, a buckle, or any other suitable mechanism for attaching the attachment arm 1998 to the support mechanism 1886.

Figure 20A:
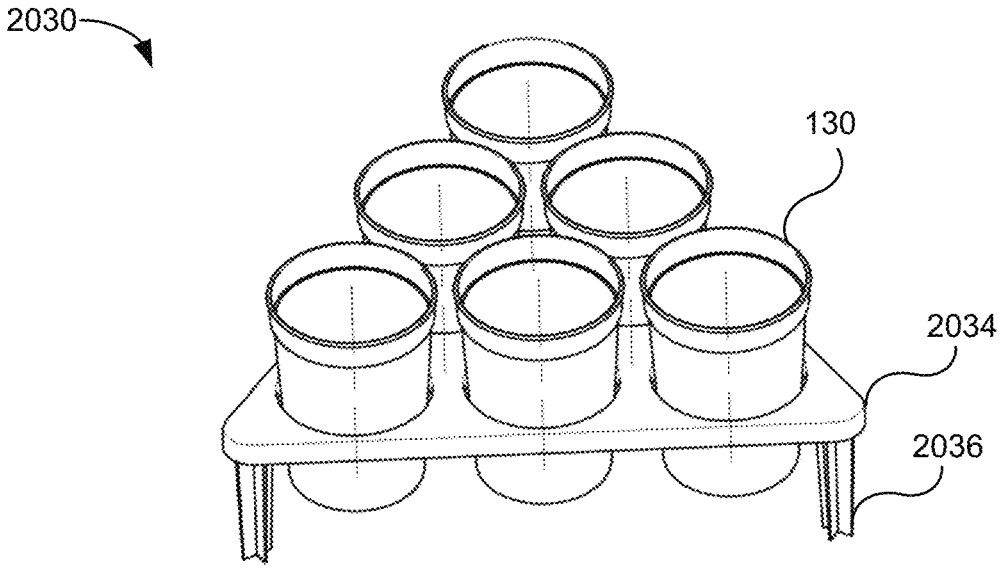
FIGS. 20A-20C illustrate a reception mechanism holder and a leg extension for the reception mechanism holder, in accordance with the disclosed technology.
Figure 20B:
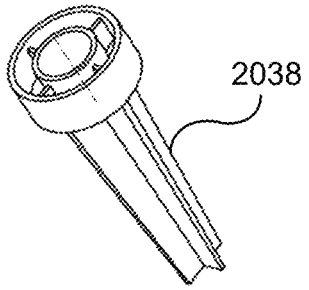
Figure 20C:
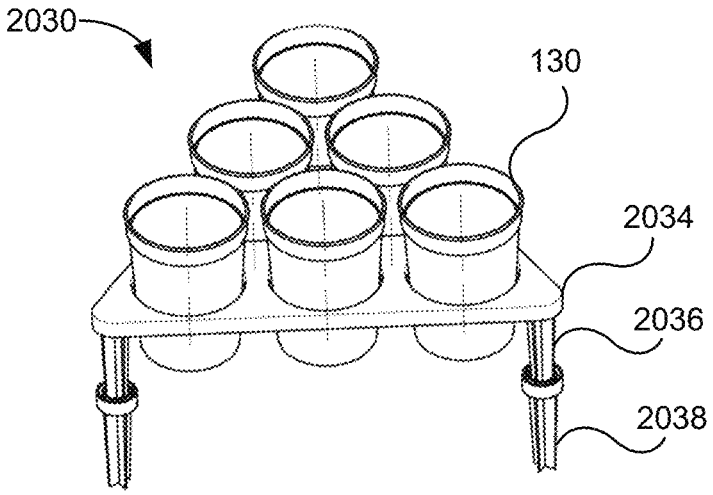

FIGS. 20A-20C illustrate a reception mechanism holder 2030 and a leg extension 2038 for the reception mechanism holder 2030, in accordance with the disclosed technology. The reception mechanism holder 2030 can be configured to receive and support one or more reception mechanisms 130. As illustrated in FIG. 20A, the reception mechanism holder 2030 can be configured to receive and support six reception mechanisms 130 such that the reception mechanisms 130 are arranged in a triangular configuration. As will be appreciated, however, the particular arrangement of the reception mechanism holder 2030 can be configured to receive and support any number of reception mechanisms 130 and arrange the reception mechanisms 130 in any shape or configuration as would be suitable for the particular application. Furthermore, the reception mechanism holder 2030 can be configured to be used along with any of the example recreational games described herein.

The reception mechanism holder 2030 can include a support plate 2034 and one or more legs 2036. The support plate 2030 can be configured to receive the reception mechanisms 130 and the legs 2036 can be configured to support the support plate 2034 such that the reception mechanisms 130 can be suspended when the reception mechanism holder 2030 is placed on a flat surface.

As illustrated in FIGS. 20B-20C, the reception mechanism holder 2030 can include an extension leg 2038 that can be configured to attach to a leg 2036 of the reception mechanism holder 2030. The extension leg 2038, for example, can be configured to be at least partially inserted into sand, dirt, grass, or other surfaces so help ensure the reception mechanism holder 2030 is prevented from sliding. The extension leg 2038 can be helpful, for example, when playing the recreational game outdoors at a beach, on a lawn, at a lake, or other setting where the reception mechanisms 130 may be moved or tipped by the throwable object 120, by wind, or other forces which may move the reception mechanisms 130. In other examples, the extension leg 2038 can be configured to raise the support plate 2034 higher above a playing surface so that longer or deeper reception mechanisms 130 can be used for the recreational game.

Figure 21:
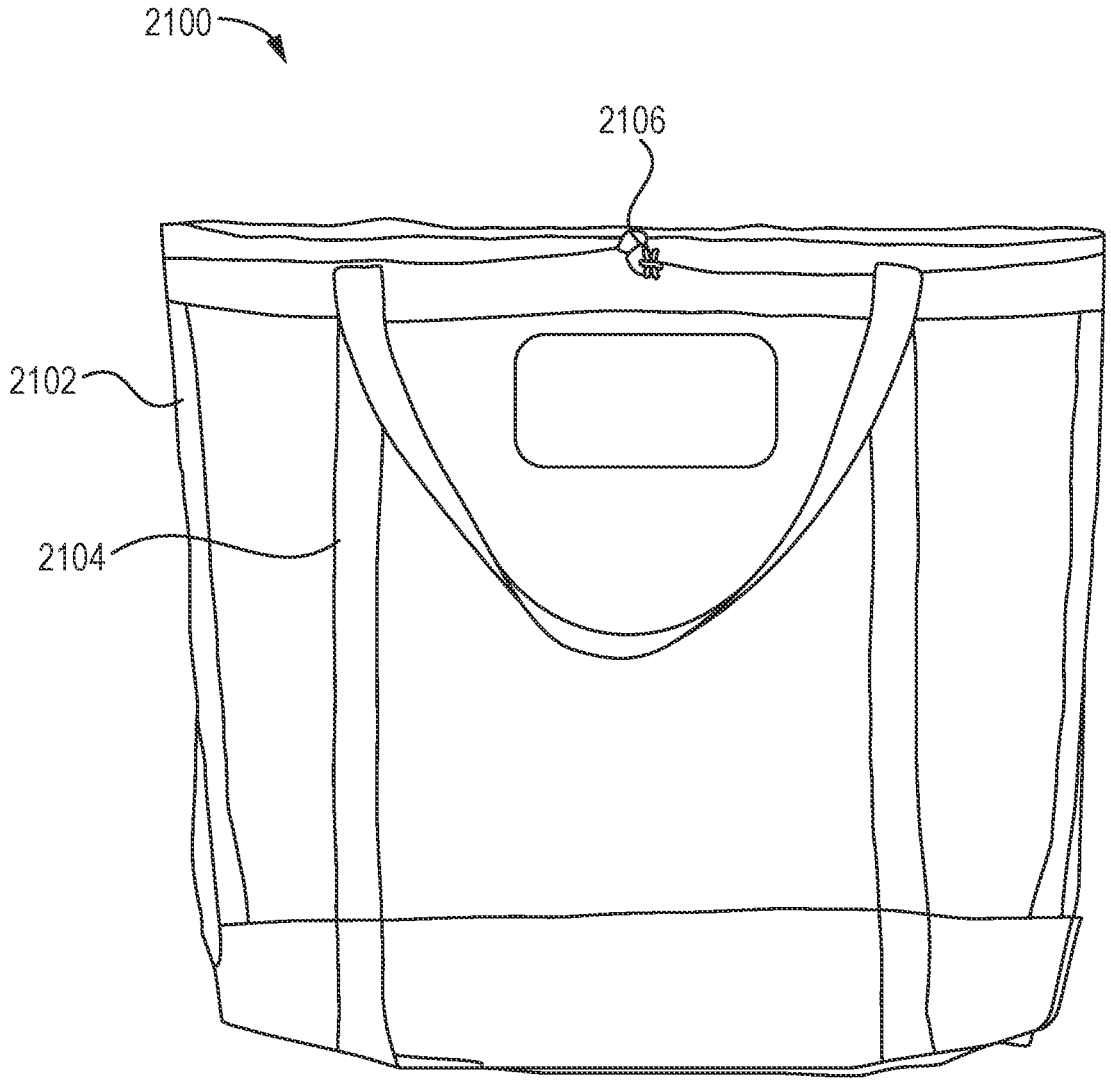
FIG. 21 illustrates a storage case for enclosing and toting the recreational game, in accordance with the disclosed technology.

FIG. 21 illustrates a storage case 2100 for enclosing and toting the recreational game, in accordance with the disclosed technology. As will be appreciated, any of the recreational games described herein can be configured for being stored and toted in the storage case 2100. The storage case 2100 can include a pouch 2102 that can be sized and configured to receive each of the components of the recreational game such that the recreational game can be stored and toted to a location for playing the recreational game. The pouch 2102 can be made from any suitable material for the particular application. The pouch 2102, for example, can be made from fabric, mesh fabric, foam, rigid plastic, metal, wood, or any other suitable material for the application.

The storage case 2100 can include a carrying handle 2104 attached to the pouch 2102. The handle 2104 can be a simple strap or the handle 2104 can be hard metal or plastic handle affixed to the pouch 2102. The storage case 2100 can include a fastener 2106 to help prevent the storage case 2100 from opening. The fastener 2106, for example, can be a draw string, a hook and loop fastener, a button and loop, a buckle, a snap fastener, magnets, or any other suitable fastener for the application. Furthermore, although not shown, the storage case 2100 can further include additional compartments for carrying some or all of the components of the recreational game.

Rules for playing any of the games described herein can vary widely. In one example, a game can have six or ten reception mechanisms (e.g., reception mechanism 130) arranged in a triangular pattern on each side of the deflection mechanism 110. The number of players on a team can be varied. In some examples, when a throwable object (e.g., throwable object 120) lands in a reception mechanism, the opposing team consumes the beverage that may be placed in the reception mechanism as a consequence. In this particular example of a game, the game is won by eliminating the other team's reception mechanisms before all of one's own team's reception mechanisms are eliminated. The losing team consumes the beverage remaining in the winning team's reception mechanisms. As another example, the game can be played by assigning points to each reception mechanism with the winning team achieving the highest score or being the first team to achieve a score of twenty-one or some other predetermined value. The game can also be played as a speed game with the winner having landed a throwable object in all of an opponent's reception mechanisms before the opponent lands a throwable object in all of the winner's reception mechanisms. As yet another example, the game can be played with each player assigning one or more of his or her own reception mechanisms to be a winning reception mechanism such that the other player will win if the winner determines which reception mechanism is the winning reception mechanism and lands a throwable object in the winning reception mechanism. As will be appreciated by one of skill in the art, any of the games described herein can be played with many variations depending on the number of players, the number of reception mechanisms, the type of deflection mechanism and throwable object, the setting, the location, and any other number of variables.

While the present disclosure has been described in connection with a plurality of example aspects, as illustrated in the various figures and discussed above, it is understood that other similar aspects can be used, or modifications and additions can be made to the described subject matter for performing the same function of the present disclosure without deviating therefrom. In this disclosure, methods and compositions were described according to aspects of the presently disclosed subject matter. But other equivalent methods or compositions to these described aspects are also contemplated by the teachings herein. Therefore, the present disclosure should not be limited to any single aspect, but rather construed in breadth and scope in accordance with the appended claims. Moreover, various aspects of the disclosed technology have been described herein as relating to methods, systems, mechanism, mechanisms, and/or non-transitory, computer-readable medium storing instructions. However, it is to be understood that the disclosed technology is not necessarily limited to the examples and embodiments expressly described herein. That is, certain aspects of a described system can be included in the methods described herein, aspects of a described mechanism or system can be included in another mechanism or system, various aspects of a described method can be included in a system described herein, and the like.

What is claimed is:

1. A recreational game comprising:

a throwable object configured to be thrown by a player of the recreational game;

reception mechanisms configured to receive the throwable object if in a path of the throwable object;

two or more reception mechanism holders; and a deflection mechanism configured to deflect the throwable object to change a direction of the throwable object when the throwable object contacts the deflection mechanism, the deflection mechanism comprising a nonplanar surface;

wherein each reception mechanism holder comprises:

a support plate having apertures extending therethrough, each aperture configured to removably receive one of the reception mechanisms; and an extension member configured to suspend each received reception mechanism by the support plate;

wherein the two or more reception mechanism holders are each configured to attach to the deflection mechanism: such that the deflection mechanism is positioned between the two or more reception mechanism holders; and to form a unitary assembly.

2. The recreational game of claim 1, wherein the deflection mechanism comprises one or more portions selected from the group consisting of a convex portion, a concave portion, and a combination thereof.

3. The recreational game of claim 1, wherein the deflection mechanism is a dome.

4. The recreational game of claim 1, wherein the deflection mechanism comprises two or more deflection sub-mechanisms configured to attach to one another.

5. The recreational game of claim 1, wherein the throwable object is selected from the group consisting of a ping pong ball and a rubber ball.

6. The recreational game of claim 1, wherein each reception mechanism comprises a cup.

7. The recreational game of claim 1, wherein at least a portion of the unitary assembly is inflatable.

8. The recreational game of claim 1 comprising eight of the reception mechanism holders, each of which is configured to support six of the reception mechanisms.

9. The recreational game of claim 1 further comprising:

a sensor configured to detect when the throwable object has been received by one of the reception mechanisms; and a controller configured to:

receive a signal from the sensor indicative of the reception mechanism having received the throwable object; and determine a score of the game based on the signal received from the sensor.

10. The recreational game of claim 9 further comprising an electronic display configured to receive instructions from the controller to display the score of the game.

11. A recreational game comprising:

a dome;

two or more reception mechanism holders; and two or more reception mechanisms;

wherein the dome is configured to deflect a path of a traveling object making contact with the dome;

wherein the reception mechanisms are locatable about the dome to receive the deflected traveling object if in the path of the deflected object;

wherein each reception mechanism holder comprises:

a support plate having apertures extending therethrough, each aperture configured to removably receive one of the reception mechanisms; and an extension member configured to suspend each received reception mechanism by the support plate;

wherein the two or more reception mechanism holders are each configured to attach to the dome:

such that the dome is positioned between the two or more reception mechanism holders; and to form a unitary assembly.

12. The recreational game of claim 11 further comprising the traveling object comprising a ball;

wherein the dome, ball, reception mechanism holders, and reception mechanisms, are each designed to form a recreational game for play on a beach.

13. The recreational game of claim 11 further comprising the traveling object comprising a ball;

wherein the dome, ball, reception mechanism holders, and reception mechanisms, are each designed to form a recreational game for play on water.

* * * * *